US005165052A

United States Patent [19]

Kirilloff et al.

[11] Patent Number: 5,165,052

[45] Date of Patent: Nov. 17, 1992

[54] SLIDE-IN RESISTOR GRID

[75] Inventors: Victor V. Kirilloff, Lincoln, Nebr.; Robert Cummins, Pittsburgh, Pa.; Richard S. Dawson, Pittsburgh, Pa.; William A. Benson, Pittsburgh, Pa.

[73] Assignee: Mosebach Manufacturing Company, Pittsburgh, Pa.

[21] Appl. No.: 691,382

[22] Filed: Apr. 25, 1991

[51] Int. Cl.[5] ..... H01C 3/00

[52] U.S. Cl. ..... 338/280; 338/299; 338/319

[58] Field of Search ..... 338/280, 295, 319

[56] References Cited

U.S. PATENT DOCUMENTS 4,316,172 2/1982 Luy ..... 338/280

4,847,585 7/1989 Kirilloff et al. .

*Primary Examiner*—Marvin M. Lateef

*Attorney, Agent, or Firm*—Buchanan Ingersoll

[57] ABSTRACT

A resistor grid for dynamic braking of diesel electric locomotives has a rigid frame comprising outer metal side pieces and metal dividers within the frame between which are positioned columns of fan-folded resistor ribbon. The dividers carry support plates having transverse aligned tabs along both sides fixed normal to the support plate, each tab having a notch in its inside edge, supported plates which slide in those slots longitudinally, the supported plates and the folds of the resistor ribbon carrying studs and bushings which interfit by movement normal to those plates.

8 Claims, 5 Drawing Sheets

SLIDE-IN RESISTOR GRID

BACKGROUND OF THE INVENTION b 1. Field of the Invention

This invention has to do with resistor grids used for dynamic braking of diesel electric locomotives. It is more particularly concerned with a resistor grid, certain parts of which are readily replaceable.

2. Description of the Prior Art

Resistor grids of the type generally used in diesel electric locomotives are the subject of Kirilloff, et al. U.S. Pat. Nos. 4,100,526 and 4,651,124. An improved resistor grid of their type is that of Kirilloff, et al. U.S. Pat. No. 4,847,585. All the above grids have several columns of fan-folded resistor material carrying studs at their folds, which studs fit into insulating bushings carried by the frame of the grid. The manufacture of a grid of that type involves fitting each insulating bushing into its place in the assembled frame, usually one after another. When a grid of that type requires repair, it is usually necessary to take the grid apart. Much time, both assembly and repair, could be saved if the grid could be sectionalized, so that individual sections could be worked on at the same time.

SUMMARY OF THE INVENTION

Our grid, to be described in detail hereinafter, comprises one or more columns of fan-folded resistor material having interfitting supporting means carried by its folds and by a frame element, those means interfitting by movement normal to said frame element. The supporting means carried by the frame element comprise said element and an elongated supported plate, which element and plate interfit by longitudinal movement there between. Insulating connections to the folds are fixed in the supported plate.

Two principal embodiments of our invention are described herein: in a first embodiment studs affixed to the folds of the resistor ribbon mate with insulated bushings fixed in a plate supported by a frame element. In a second embodiment insulated studs affixed to a plate supported by a frame element mate with holes in the folds of the resistor ribbon.

PREFERRED MODE

Figure 1:
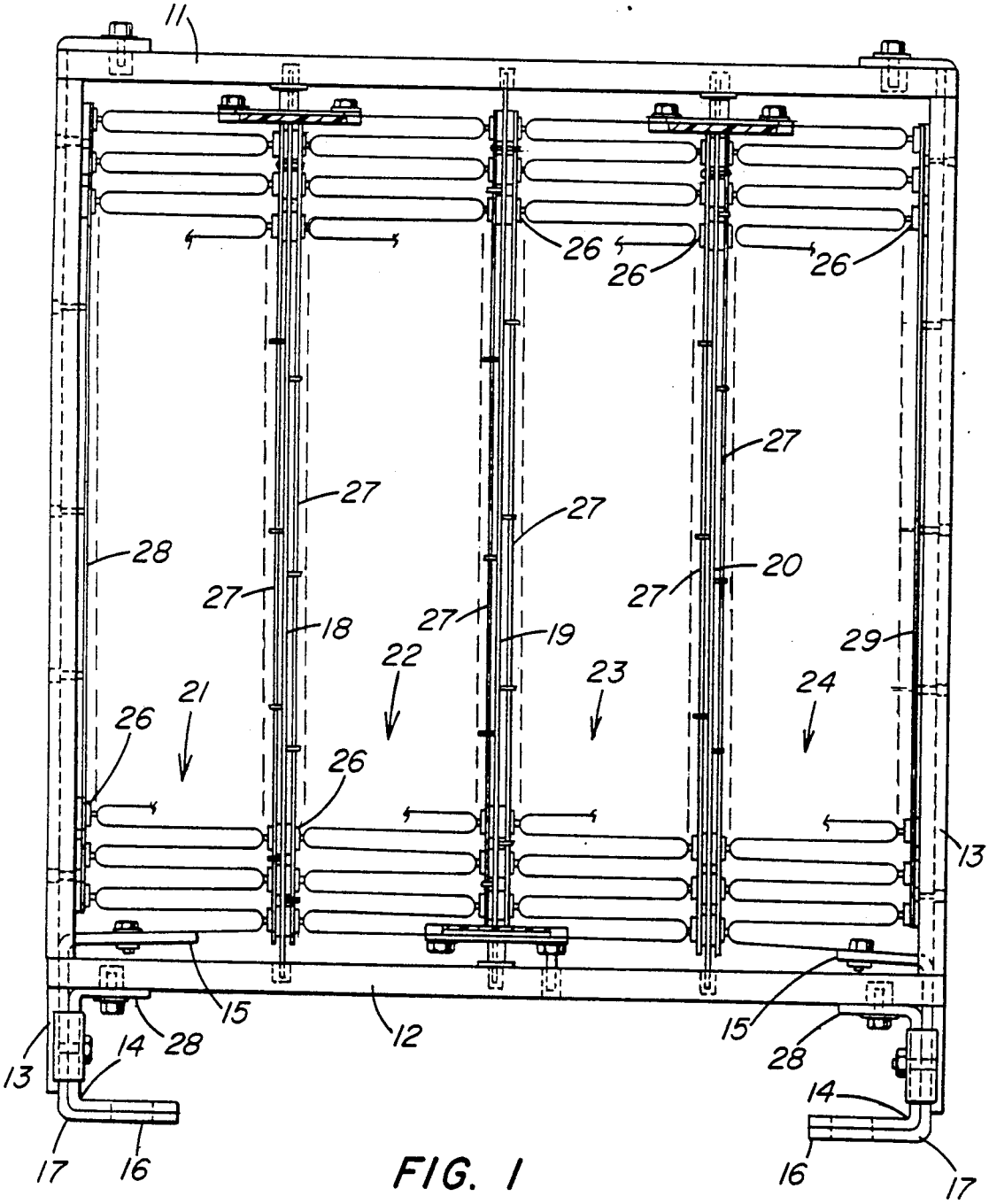
FIG. 1 is an elevation of a typical resistor grid embodying the first embodiment of our invention.
Figure 2:
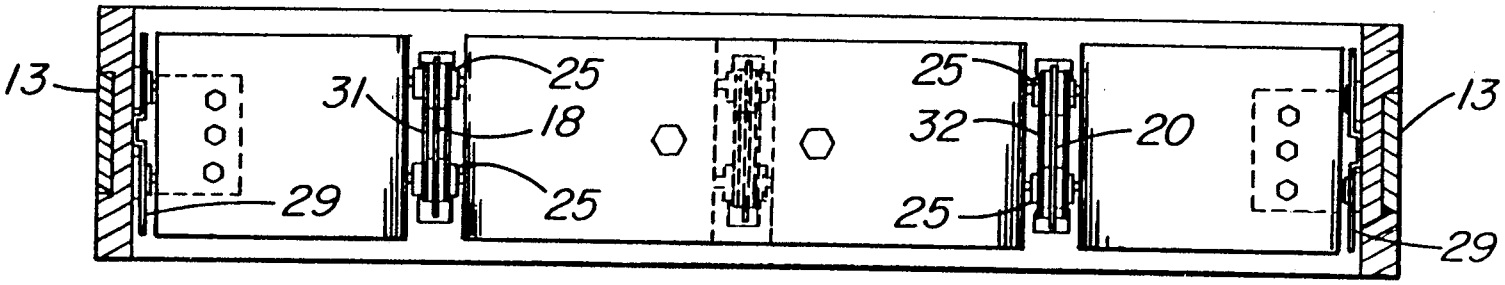
FIG. 2 is an inverted plan of the grid of FIG. 1 taken on the plane A—A.

The first preferred mode of our grid is assembled in a frame shown in FIG. 1, having a top member 11 and a bottom member 12, preferably of insulating material, and side members 13—13 shown in FIGS. 1 and 2 of metal, preferably steel. Side members 13—13 extend below bottom member 12 and are each bolted to U-shaped metal pieces 14 and 17, the upper leg 15 of each piece 17 is electrically connected to one end of the resistance element, to be described hereinafter, and the lower leg 16 of each piece 17 forms a mounting foot and terminal.

The upper ends of side members 13—13 are bent over and bolted to top member 11; the upper legs 28 of pieces 14 are bolted to bottom member 12.

Figure 5:
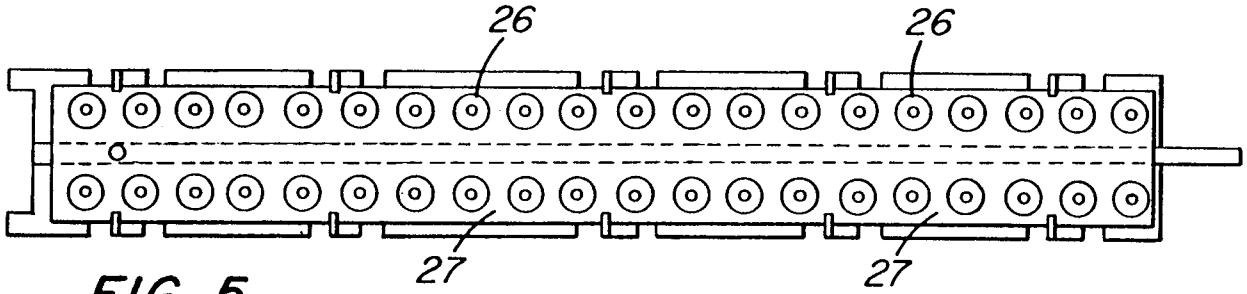
FIG. 5 is a plan of a subassembly of support plate, supported plate and insulating bushings of FIG. 1.
Figure 6:
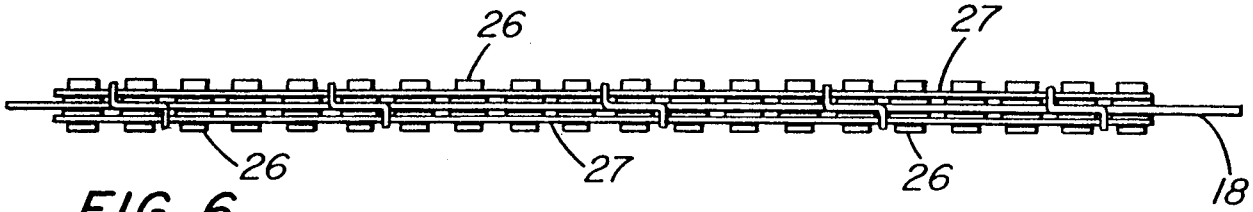
FIG. 6 is an elevation of the subassembly of FIG. 5.
Figure 7:
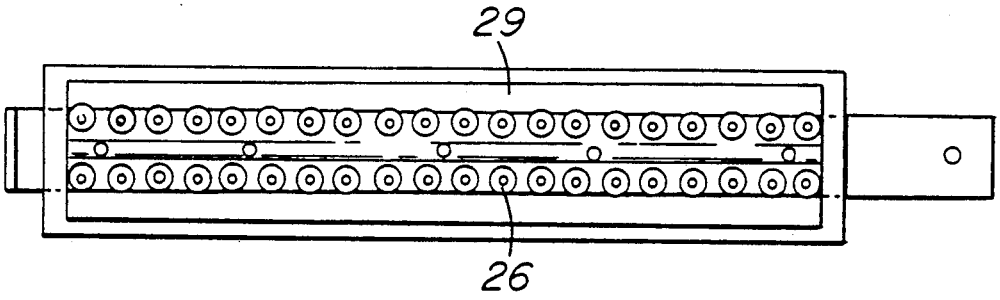
FIG. 7 is a plan of a supported plate carrying bushings mounted on a side member of our grid of FIG. 1.
Figure 8:
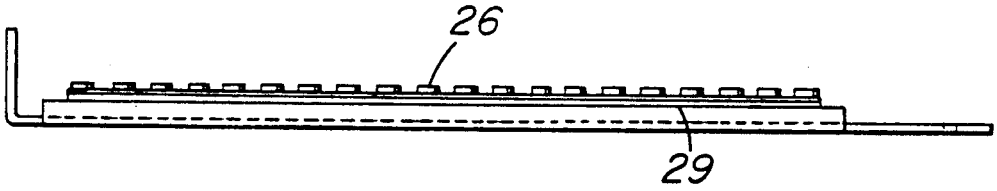
FIG. 8 is an elevation of the assembly of FIG. 7.

The space within the frame is divided by vertical steel support plates 18, 19 and 20, into compartments for four columns of fan-folded resistor ribbon 21, 22, 23, and 24. On each fold are fastened two studs 25 shown in FIG. 2 as is known in the prior art, for example Kirilloff, et al. U.S. Pat. No. 4,847,585. Those studs 25 mate with insulating bushings 26 usually carried by the frame, as is also known in the art. In our assembly, the ceramic bushings 26 carried by support plates 18, 19, and 20, are mounted in a single supported plate 27 as shown in FIGS. 5 and 6 on each face of each plate. The ceramic bushings 26 carried by frame members 13 are mounted in like supported plates 29, which are affixed to those frame members respectively.

Figure 3:
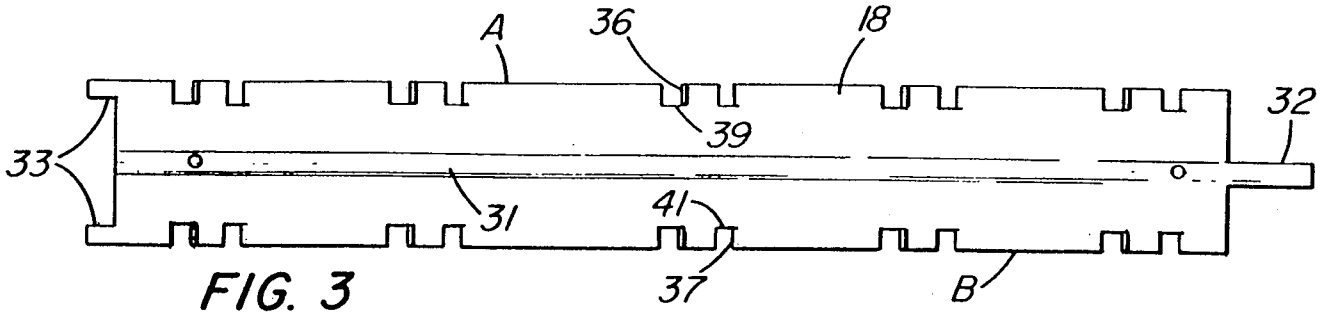
FIG. 3 is a detail of a support plate of the grid of FIG. 1.

Plates 18, 19 and 20 are formed with a central longitudinal stiffening rib 31 as shown in FIGS. 2 and 3. That rib 31 extends from one end of those plates into a central prong 32. At its other end, plate 18 is formed with extensions 33 on each side. Those extensions at each end fit into holes in top and bottom frame members 11 and 12, having depths which position plates 18, 19 and 20 respectively, so that the bushings carried by each are properly aligned with respect to the bushings carried by their neighboring plates, or by bushing members 29 carried by side members 13 and 14.

Supported plates 29 are mounted on side members 13 and 14 by screws, rivets, or other conventional means. Supported plates 27 are removably mounted on support plates 18, 19 or 20. Support plate 18, which is typical, has rectangular tabs 36 bent normal to plate 18 from cutouts 39 thereon, on each side, facing one end of plate 18 and rectangular tabs 37 bent normal to the opposite face of plate 18 from cutouts 41 thereon, on each side, facing the other end of support plate 18. All tabs 36 and 37 are parallel to each other and preferably aligned with their opposite side tabs. Each tab 36 and 37 has a notch 40 cut into its inside edge parallel to plate 18, the notches being dimensioned and spaced so that when the frame is disassembled each opposite side pair accepts a supported plate 27 when that plate is slid parallel and aligned with plate 18 into those successive pairs of notches 40 along the length of plate 18. Likewise, supported plate 27 carrying its insulating bushings can be slid out of notches 40. It is, of course, necessary to disengage the studs carried by the folds of the fan-folded resistance ribbon from their insulating bushings to remove or replace a supported plate, but the resistance ribbon is sufficiently flexible to permit such disengagement and re-engagement.

Figure 12:
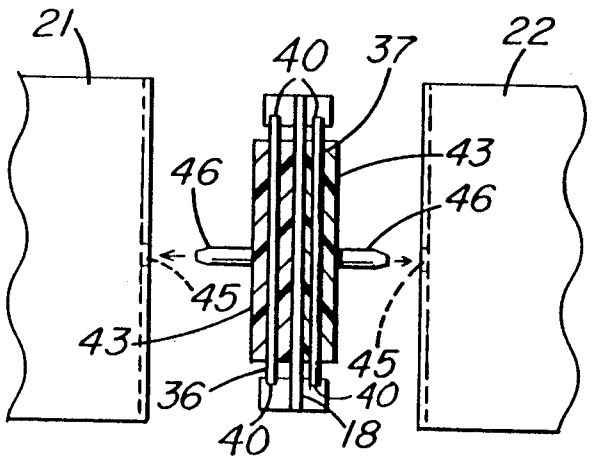
FIG. 12 illustrates the second preferred mode of our invention in plan, partly in section, similar to that of FIG. 2, but differing therefrom in that the folds of the resistor ribbon do not carry studs, but merely holes mating with studs, which studs are carried by panels of insulating material removably affixed to support plates by means corresponding to supported plates previously mentioned.

The second preferred mode differs from the first mode described above principally in interchanging the studs and their receptacles. As is shown in FIG. 12, studs 46 are fixed in panels of insulating material 43 which are attached to support plate 18 in the same way as has been described in our first embodiment. That plate fits into the notches 40 of tabs 36 and 37 as previously described. Holes 45 are formed in the folds of the resistor ribbon 21 and 22 to mate with opposite studs 46 when the ribbon is in place.

Figure 9:
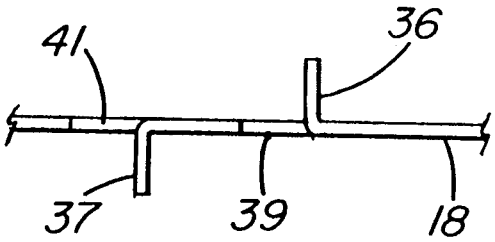
FIG. 9 is an end elevation of a portion of the support plate of FIG. 3 showing the tabs on both faces of the plate.
Figure 4:
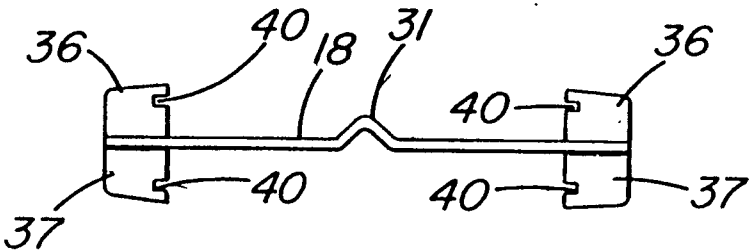
FIG. 4 is a cross section of the support plate of FIG. 3.
Figure 11:
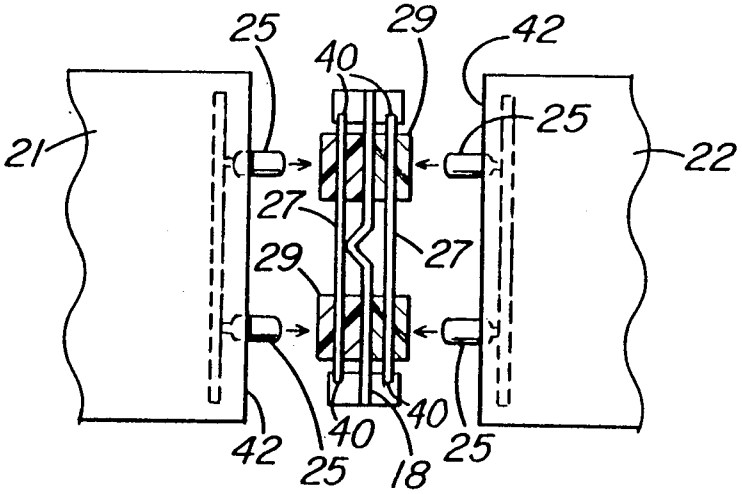
FIG. 11 is a similar disassembled plan, partly in section, of the general arrangement of FIG. 10, but with the folded ends of adjoining columns of resistor ribbon being formed each with a projecting flat flange in which flange the studs are mounted, and strips of insulating material extending the length of the supported plate with holes therein mating with the studs.
Figure 10:
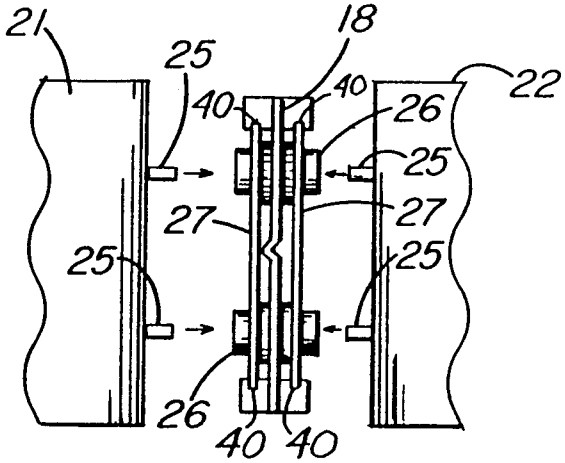
FIG. 10 is a disassembled plan, partly in section, of the folded stud carrying ends of adjoining columns of resistor ribbon, their common support plate and their supported plates and bushings fitted therein.

FIGS. 10 and 11 show two variations of our first embodiment. In FIG. 10 the folded adjoining ends of ribbon columns 21 and 22 have studs 25, preferably two each, welded thereto. Support plate 18 supports supported plates 27, one on each side, which plates slide longitudinally into and out from support plate 18 through the notches 40 in the tabs 36 and 37 shown in FIGS. 3, 4 and 9. Insulated bushings 26 are mounting in supported plates 27. Studs 25 mate with bushings 26.

In FIG. 11, the folded adjoining ends of ribbon columns 21 and 22 are folded to form a flat tab 42 projecting at each folded end of the columns. Studs 25 are welded to that tab so as to extend longitudinally therefrom. Those studs mate with holes in strips of insulating material 29, which strips extend longitudinally of the supported plate 27. If necessary, the strip 29 on the face of plate 27 can be backed up by a like strip between that member and support member 18 a distance sufficient to prevent studs 25 from shorting against support member 18.

The second preferred mode of our invention differs from the first mode described above only in interchanging the studs and their receptacles. As shown in FIG. 12, studs 46 are fixed in panels of insulating material 43 which are mounted on support plate 18. The panels are fixed in supported plate 47 which corresponds to the supported plate 27 in our first embodiments described hereinabove. The plate fits into the notches 40 of tabs 36 and 37 on plate 18 as previously has been described. Holes 45 ar formed in the folds of the resistor ribbon 21 and 22 so as to mate with opposing studs 46 when the ribbon is in place. Although FIG. 12 shows a single stud for each fold, the panel 43 may hold a pair of studs and the folded end of the resistor ribbon adjoining may have two holes, each mating with one of those studs.

I claim:

1. An improved rectangular resistor grid having one or more parallel columns of fan-folded resistor ribbon, each column being supported at its folds in the resistor grid frame by means comprising an elongated support plate affixed to said frame and a supported plate supported from said support plate, said support plate having notches formed therein so that said supported plate is slidingly received with said notches thereby permitting longitudinal movement between said plates, said supported plate and said resistor ribbon having insulated support means interfitting by movement normal to said plate.

2. The improved rectangular resistor grid of claim 1 in which said notches are formed in tabs normal to said support plate along each side, each tab having a notch in its inside edge wide enough to accommodate the thickness of said supported plate, the spacing between the inside edges of said notches on opposite sides being wide enough to accommodate the width of said supported plate.

3. The resistor grid of claim 1 in which said insulated support means between said supported plate and said resistor ribbon comprise studs affixed to said support plate but insulated therefrom and openings in said resistor strip folds into which openings said studs fit.

4. The resistor grid of claim 1 in which said support plate has a longitudinally extending offset stiffening rib.

5. The resistor grid of claim 2 in which said tabs are bent out of said support plate.

6. The resistor grid of claim 5 in which said tabs are positioned on said support plate on each side thereof.

7. The resistor grid of claim 3 in which said studs are insulated from said support plate by a strip of longitudinally extending insulating material.

8. The resistor grid of claim 1 in which said support plate is supported at an end in said resistor grid by an extension of its said end.

* * * * *